US012779623B2

(12) United States Patent
Kadono

(10) Patent No.: US 12,779,623 B2
(45) Date of Patent: Nov. 3, 2026

(54) GRINDING APPARATUS

(71) Applicant: NTN Corporation, Osaka (JP)

(72) Inventor: Yuuki Kadono, Iwata (JP)

(73) Assignee: NTN Corporation, Osaka (JP)

( * ) Notice: Subject to any disclaimer, the term of this patent is extended or adjusted under 35 U.S.C. 154(b) by 444 days.

(21) Appl. No.: 18/262,819

(22) PCT Filed: Feb. 4, 2022

(86) PCT No.: PCT/JP2022/004437
§ 371 (c)(1),
(2) Date: Jul. 25, 2023

(87) PCT Pub. No.: WO2022/168944
PCT Pub. Date: Aug. 11, 2022

(65) Prior Publication Data

US 2024/0408720 A1 Dec. 12, 2024

(30) Foreign Application Priority Data

Feb. 8, 2021 (JP) ..... 2021-018401

(51) Int. Cl.
*B24B 49/00* (2012.01)
*B24B 49/10* (2006.01)
*B24B 51/00* (2006.01)

(52) U.S. Cl.
CPC ..... *B24B 49/003* (2013.01); *B24B 49/10* (2013.01); *B24B 51/00* (2013.01)

(58) Field of Classification Search
CPC ..... G05B 2219/45161; G05B 19/4166; G05B 19/4163; G05B 19/37; G05B 19/285;
(Continued)

(56) References Cited

U.S. PATENT DOCUMENTS 4,821,460 A * 4/1989 Wegmann ..... B24B 47/20 73/660
4,831,758 A * 5/1989 Williams ..... G09F 1/10 40/389

(Continued)

FOREIGN PATENT DOCUMENTS

CN 108161722 A * 6/2018 ..... B24B 41/005
CN 110757336 A 2/2020

(Continued)

OTHER PUBLICATIONS

Machine translation of JP-2014217914-A (Year: 2014).*

(Continued)

*Primary Examiner* — Robert F Neibaur
(74) *Attorney, Agent, or Firm* — Rimon P.C.

(57) ABSTRACT

A grinding apparatus includes: a grinding member driving unit having a motor that rotates a grinding member; a table driving unit that brings the grinding member into contact with a workpiece by moving the grinding member and the workpiece relative to each other; an AE sensor that detects an acoustic emission generated when the grinding member and the workpiece are brought into contact with each other; and a controller that controls a cut-in speed of the grinding member into the workpiece by controlling the table driving unit. The controller controls the cut-in speed using an output of the AE sensor and a motor current of the grinding member driving unit.

3 Claims, 8 Drawing Sheets

(58) Field of Classification Search
CPC ..... B24B 49/16; B24B 49/10; B24B 49/003; B24B 49/04; B24B 447/22; B24B 47/20; B24B 41/04; B24B 41/005; B23Q 17/2241; B23Q 17/22; B23Q 17/15822; B23Q 17/225
USPC ..... 451/5, 9, 10, 11
See application file for complete search history.

(56) References Cited

U.S. PATENT DOCUMENTS

| | | | | |
|---|---|---|---|---|
| 2007/0066183 | A1 | 3/2007 | Chang et al. | |
| 2009/0291619 | A1* | 11/2009 | Tomita | B24B 47/22 451/51 |
| 2016/0013085 | A1* | 1/2016 | Chew | H01L 21/76898 156/345.13 |
| 2018/0193978 | A1* | 7/2018 | Watanabe | B24B 5/045 |

FOREIGN PATENT DOCUMENTS

| | | | | | |
|---|---|---|---|---|---|
| JP | 63-200944 | A | | 8/1988 | |
| JP | 63-300842 | A | | 12/1988 | |
| JP | 2002103219 | A | * | 4/2002 | |
| JP | 2014217914 | A | * | 11/2014 | B24B 49/04 |
| JP | 2016-112649 | A | | 6/2016 | |
| JP | 2018-167348 | A | | 11/2018 | |
| JP | 6492613 | B2 | | 4/2019 | |

OTHER PUBLICATIONS

Machine translation of CN-108161722-A (Year: 2018).*
Machine translation of JP-2002103219-A (Year: 2002).*
International Search Report issued in International Application No. PCT/JP2022/004437 dated Apr. 5, 2022 with English translation.

* cited by examiner

GRINDING APPARATUS

CROSS REFERENCE TO RELATED APPLICATIONS

This application is the U.S. National Phase under 35 U.S.C. § 371 of International Application No. PCT/JP2022/004437, filed on Feb. 4, 2022, which claims the benefit of Japanese Application No. 2021-018401, filed on Feb. 8, 2021, and the entire contents of each are hereby incorporated by reference.

TECHNICAL FIELD

The present invention relates to a grinding apparatus that grinds a workpiece by bringing a grinding member (such as a grinding wheel), which is being rotated, into contact with the workpiece.

BACKGROUND ART

As a technique for grinding a workpiece by bringing a grinding member, which is being rotated, into contact with the workpiece, the following technique has been conventionally known: whether or not the grinding member and the workpiece are brought into contact with each other is determined based on a current (grinding motive power) of a motor that rotates the grinding member, and a cut-in speed of the grinding member into the workpiece is controlled in accordance with a result of the determination. Specifically, until the contact is detected, the cut-in speed is set to a relatively high value so as to promptly bring the grinding member into contact with the workpiece. On the other hand, after the contact is detected, the cut-in speed is switched to a relatively low value so as to suppress troubles such as deterioration of the grinding member or burn of the workpiece due to the grinding. Thus, the grinding can be appropriately performed while reducing an overall machining time.

There is a time lag between a change in grinding load due to the grinding member and the workpiece being brought into contact with each other and a change in current (grinding motive power) of the motor that rotates the grinding member. Therefore, it is concerned that when the cut-in speed is controlled based on the current of the motor, a timing of switching the cut-in speed is considerably lagged behind a timing at which the grinding member is actually brought into contact with the workpiece.

To address this, for example, Japanese Patent No. 6492613 (PTL 1) discloses a grinding apparatus including an AE sensor that detects an acoustic emission (hereinafter also referred to as "AE") generated when a grinding member is brought into contact with a workpiece. This grinding apparatus performs feedback-control on a cut-in speed of the grinding member based on an output signal of the AE sensor having high sensitivity to a fluctuation of grinding load. Therefore, as compared with a case where the cut-in speed of the grinding member is feedback-controlled based on electric power of a motor, followability of the control of the cut-in speed to the fluctuation of the grinding load is improved. As a result, the timing of switching the cut-in speed of the grinding member is suppressed from being lagged behind the timing at which the grinding member is actually brought into contact with the workpiece.

CITATION LIST

Patent Literature

PTL 1: Japanese Patent No. 6492613

SUMMARY OF INVENTION

Technical Problem

The AE sensor having high sensitivity to the fluctuation of the grinding load detects a state in which the grinding member is brought into extremely small contact with the workpiece. Therefore, it is concerned that when the cut-in speed of the grinding member is controlled based only on the output signal of the AE sensor as in the grinding apparatus disclosed in Japanese Patent No. 6492613, the cut-in speed is switched to the lower value earlier than necessary, with the result that the effect of reducing the overall machining time cannot be sufficiently obtained.

The present disclosure has been made to solve the above-mentioned problem, and has an object to appropriately reduce an overall machining time while appropriately performing grinding.

Solution to Problem

A grinding apparatus according to the present disclosure includes: a rotation apparatus having a motor that rotates a grinding member; a moving apparatus that brings the grinding member into contact with a workpiece by moving the grinding member and the workpiece relative to each other; an AE sensor that detects an acoustic emission generated when the grinding member and the workpiece are brought into contact with each other; and a controller that controls a cut-in speed of the grinding member into the workpiece by controlling the moving apparatus. The controller controls the cut-in speed using an output of the AE sensor and an output of the motor.

Advantageous Effects of Invention

According to the present disclosure, the cut-in speed of the grinding member can be switched in two stages at appropriate timings by using both the output of the AE sensor and the output of the motor. Thus, the overall machining time can be more appropriately reduced while appropriately performing grinding.

DESCRIPTION OF EMBODIMENTS

Figure 1:
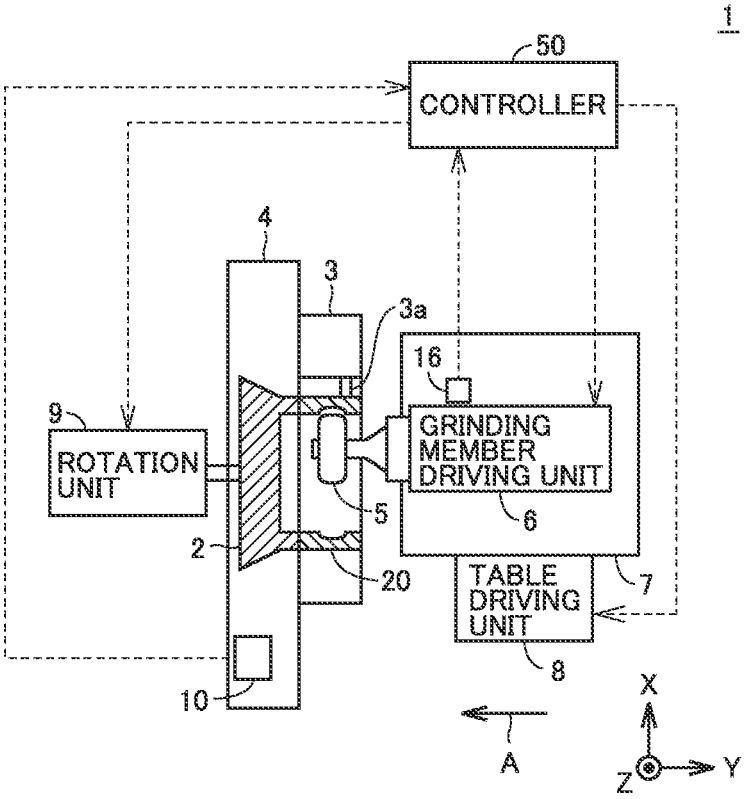
FIG. 1 is a diagram showing a schematic configuration of a grinding apparatus.

Hereinafter, embodiments of the present disclosure will be described with reference to figures. It should be noted that in the below-described figures, the same or corresponding portions are denoted by the same reference characters, and will not be described repeatedly.

(Configuration)

Figure 2:
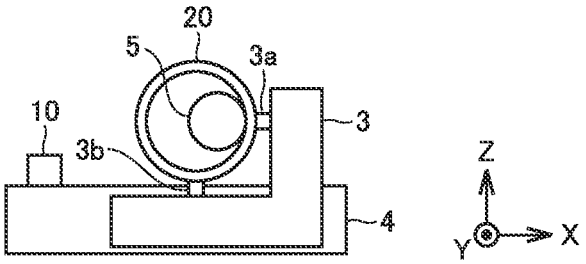
FIG. 2 is a diagram showing a state of the grinding apparatus when viewed in a direction of arrow A shown in FIG. 1.

FIG. 1 is a diagram showing a schematic configuration of a grinding apparatus 1 according to the present embodiment. FIG. 2 is a diagram showing a state of grinding apparatus 1 when viewed in a direction of arrow A shown in FIG. 1.

It should be noted that in FIG. 1, a workpiece 20 and a workpiece holding unit 2 are shown in a cross sectional view along a plane parallel to an X axis direction and a Y axis direction. The Y axis direction is a direction along a rotation axis of a grinding member 5, the X axis direction is a direction along a feeding direction (cut-in direction) of grinding member 5 into workpiece 20, and a Z axis direction is a direction orthogonal to the X axis direction and the Y axis direction. In FIG. 2, workpiece holding unit 2, a grinding member driving unit 6, a movable table 7, a table driving unit 8, a rotation unit 9, and a controller 50 are not shown.

Grinding apparatus 1 includes workpiece holding unit 2, supporting bases 3, 4, grinding member 5, grinding member driving unit 6, movable table 7, table driving unit 8, rotation unit 9, an AE sensor 10, and controller 50.

Workpiece holding unit 2 holds workpiece 20 to be ground. Workpiece holding unit 2 can hold workpiece 20 by attracting and fixing workpiece 20 by magnetic force such as electromagnetic force, for example. Workpiece holding unit 2 may be, for example, a backing plate.

Supporting base 3 is attached to a side surface (end surface in a Y-axis positive direction) of supporting base 4. Supporting base 3 has positioning supporting portions 3*a*, 3*b* to support an outer periphery of workpiece 20 at two positions. Each of positioning supporting portions 3*a*, 3*b* may be a shoe, for example. Workpiece 20 illustrated in FIGS. 1 and 2 is a member having a cylindrical shape (for example, an outer ring or inner ring of a bearing). A material for each of supporting bases 3, 4 is steel. It should be noted that the material for each of supporting bases 3, 4 may be a metal other than steel.

Grinding member driving unit 6 includes a motor that rotates grinding member 5 about an axis that is parallel to the Y axis direction and that serves as a rotation axis. Grinding member driving unit 6 is an exemplary "rotation apparatus" of the present disclosure. Grinding member 5 may be, for example, a grinding wheel.

Grinding member driving unit 6 includes a current sensor 16. Current sensor 16 detects a current (hereinafter, also simply referred to as "motor current") of the motor that rotates grinding member 5, and outputs a signal indicating a detection result to controller 50.

Grinding member driving unit 6 is fixed to movable table 7 that is movable at least in the X axis direction. Movable table 7 may be, for example, a cross slide.

Table driving unit 8 moves movable table 7 in the X axis direction to move workpiece 20 and grinding member 5 relative to each other, thereby bringing the outer periphery of grinding member 5, which is being rotated, into contact with workpiece 20. Each of movable table 7 and table driving unit 8 is an apparatus that move grinding member 5 relative to workpiece 20 in the cut-in direction (X axis direction), and is an exemplary "moving apparatus" of the present disclosure. It should be noted that although FIG. 1 illustrates the configuration in which grinding member 5 is moved in the X axis direction, the moving apparatus may be any apparatus as long as at least one of grinding member 5 and workpiece 20 is moved in the X axis direction, and may be an apparatus that moves workpiece 20 in the X axis direction, for example.

Rotation unit 9 rotates workpiece holding unit 2 and workpiece 20 about an axis that is parallel to the Y axis direction and that serves as a rotation axis, thereby changing a contact position of workpiece 20 with grinding member 5, i.e., a ground position of workpiece 20.

AE sensor 10 detects an acoustic emission generated when grinding member 5 is brought into contact with workpiece 20. AE sensor 10 is fixed to an upper surface (end surface in a Z-axis positive direction) of supporting base 4. By fixing AE sensor 10 to supporting base 4, the acoustic emission propagating from workpiece 20 to supporting bases 3, 4 can be detected.

Since the AE wave (longitudinal wave) propagates at a high speed of about 5900 m/s through supporting bases 3, 4 each composed of steel and it takes a very short time (for example, about 0.05 ms) for the AE wave generated from the contact portion between grinding member 5 and workpiece 20 to propagate through supporting bases 3, 4 and reach AE sensor 10, AE sensor 10 can be installed on supporting base 4 serving as a base member that supports supporting base 3, rather than supporting base 3 that directly supports workpiece 20.

Controller 50 is implemented by, for example, an electronic circuit including a CPU (Central Processing Unit) and a memory such as a ROM (Read Only Memory) and a RAM (Random Access Memory).

Controller 50 controls a rotation speed of workpiece 20 rotated by rotation unit 9.

Controller 50 controls table driving unit 8 to switch the cut-in speed of grinding member 5 into workpiece 20 based on an output signal of AE sensor 10 and an output signal of current sensor 16.

In the present specification, the "cut-in speed" represents a feeding speed in a feeding motion of grinding member 5 to cut workpiece 20. In the present embodiment, the cut-in speed is a moving speed of grinding member 5 moved in the X axis direction by table driving unit 8.

Figure 3:
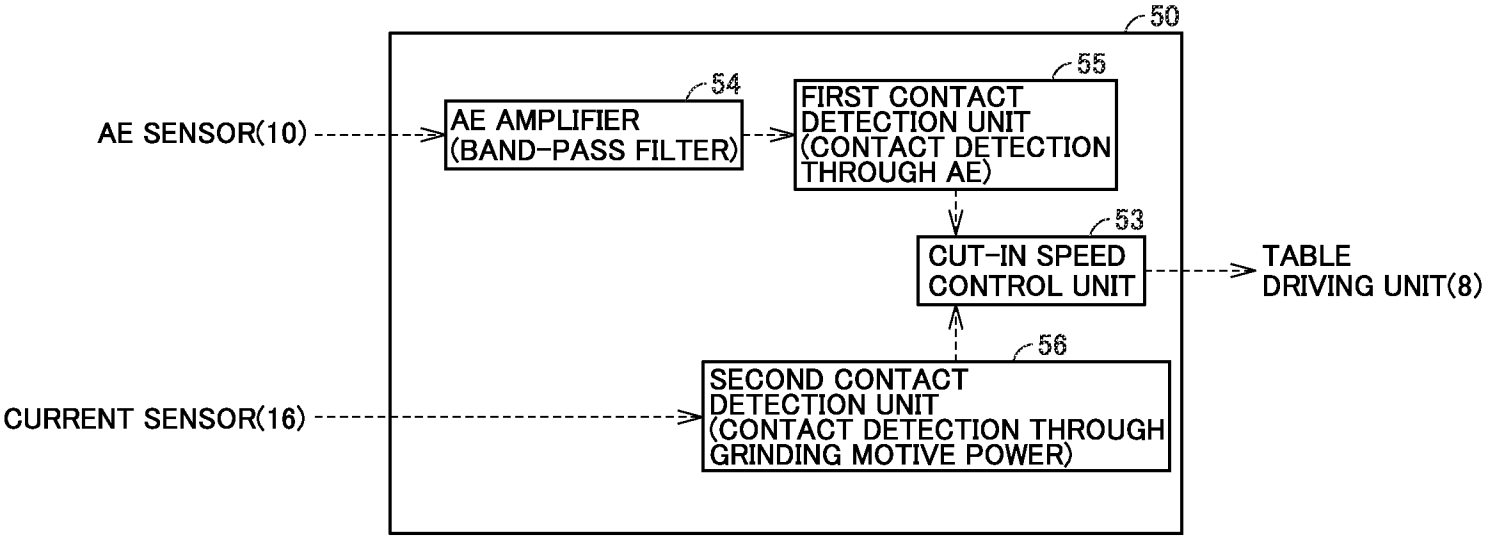
FIG. 3 is a control block diagram of a controller.

FIG. 3 is a control block diagram of controller 50. Controller 50 includes a cut-in speed control unit 53, an AE amplifier 54, a first contact detection unit 55, and a second contact detection unit 56.

Cut-in speed control unit 53 controls table driving unit 8 so as to control the cut-in speed of grinding member 5 into workpiece 20. A method of controlling the cut-in speed will be described in detail later.

AE amplifier 54 is a device having a band-pass filter that only allows for passage of a signal in a specific frequency region with regard to the AE wave signal detected by AE sensor 10. By appropriately setting the band-pass filter, an influence of noise can be removed from the AE wave signal detected by AE sensor 10.

First contact detection unit 55 detects contact between grinding member 5 and workpiece 20 based on the AE wave signal having passed through AE amplifier 54. Specifically, when an intensity of the AE wave having passed through AE amplifier 54 is more than a predetermined AE threshold value, first contact detection unit 55 detects that grinding member 5 and workpiece 20 are brought into contact with each other. Hereinafter, the contact detected by first contact detection unit 55 is also referred to as "contact detection through AE".

Second contact detection unit 56 detects contact between grinding member 5 and workpiece 20 based on the motor current detected by current sensor 16. Specifically, when the motor current is more than a predetermined motive power threshold value, second contact detection unit 56 detects that grinding member 5 and workpiece 20 are brought into contact with each other. Hereinafter, the contact detected by second contact detection unit 56 is also referred to as "contact detection through grinding motive power". It should be noted that the contact detection through grinding motive power is not necessarily limited to one performed using the motor current detected by current sensor 16. For example, instead of the motor current detected by current sensor 16, the contact detection through grinding motive power may be performed using a command value of the motor current generated by a grinding member rotation speed control unit.

Cut-in speed control unit 53 controls the cut-in speed of grinding member 5 into workpiece 20 based on a detection result obtained by first contact detection unit 55 (a result of the contact detection through AE) and a detection result obtained by second contact detection unit 56 (a result of the contact detection through grinding motive power).

(Control of Cut-In Speed)

In order to appropriately perform grinding while reducing an overall machining time, it is desirable to set the cut-in speed to a relatively high value until the contact between grinding member 5 and workpiece 20 is detected, and to switch the cut-in speed to a relatively low value after the contact between grinding member 5 and workpiece 20 is detected.

However, there is a time lag between a change in grinding load due to grinding member 5 and workpiece 20 being brought into contact with each other and a change in motor current (grinding motive power). Therefore, when the cut-in speed of grinding member 5 is switched to a low value at a timing of the contact detection through grinding motive power, the timing of switching the cut-in speed to the low value is considerably lagged behind a timing at which grinding member 5 is actually brought into contact with workpiece 20. As a result, even after grinding member 5 is brought into contact with workpiece 20, the cut-in speed of grinding member 5 is maintained at a high value for a while. Thus, grinding member 5 is deeply cut into workpiece 20, thus resulting in a trouble such as deformation of the surface of grinding member 5 or burn of workpiece 20 due to the grinding. Further, the following another problem arises when the cut-in speed of grinding member 5 is high: a grinding liquid existing between grinding member 5 and workpiece 20 is involved to greatly increase the grinding motive power, with the result that grinding member 5 and workpiece 20 may be erroneously detected as being brought into contact with each other even though grinding member 5 and workpiece 20 are not actually brought into contact with each other. Therefore, if the cut-in speed of grinding member 5 is decreased based only on the result of the contact detection through grinding motive power, the cut-in speed before switching is restricted to a speed at which the contact between grinding member 5 and workpiece 20 can be normally detected.

On the other hand, AE sensor 10 having a high sensitivity to a fluctuation of the grinding load detects a state in which grinding member 5 is brought into extremely small contact with workpiece 20. Therefore, it is concerned that when the cut-in speed of grinding member 5 is switched to a low value at a timing of the contact detection through AE, the cut-in speed is switched to a low value earlier than necessary, with the result that the effect of reducing the overall machining time cannot be sufficiently obtained.

In view of the above, cut-in speed control unit 53 according to the present embodiment switches the cut-in speed of grinding member 5 in two stages at appropriate timings by using both results of the contact detection through grinding motive power and the contact detection through AE. Thus, the overall machining time can be more appropriately reduced while appropriately performing grinding.

Figure 4:
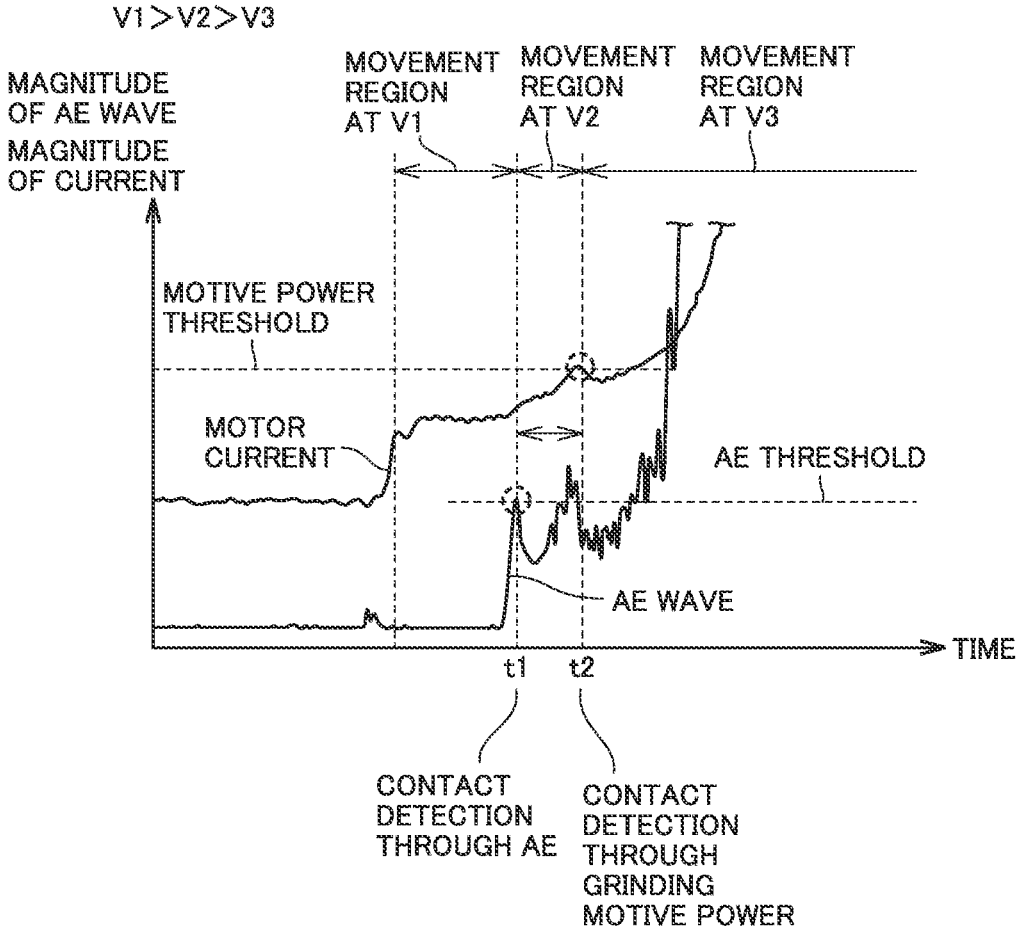
FIG. 4 is a diagram showing an exemplary manner of change in each of a motor current and an AE wave during grinding.

FIG. 4 is a diagram showing an exemplary manner of change in each of the motor current (grinding motive power) and the AE wave during grinding. In FIG. 4, a time t1 at which the intensity of the AE wave is detected to be more than the AE threshold is a timing of the contact detection through AE. A time t2 at which the strength of the grinding motive power is detected to be more than the motive power threshold is a timing of the contact detection through grinding motive power.

As described above, the timing (time t2) of the contact detection through grinding motive power tends to be lagged behind the timing of attaining the actual contact. On the other hand, since AE sensor 10 has high sensitivity to a fluctuation of grinding load, the timing of the contact detection through AE substantially coincides with the timing of attaining the actual contact. As a result, as shown in FIG. 4, the timing (time t1) of the contact detection through AE comes earlier than the timing (time t2) of the contact detection through grinding motive power.

By utilizing this point, in the present embodiment, the cut-in speed is set to a relatively high first cut-in speed V1 before the timing (time t1) of the contact detection through AE. Thereafter, the cut-in speed is switched from first cut-in speed V1 to a second cut-in speed V2 at the timing (time t1) of the contact detection through AE, second cut-in speed V2 being lower than first cut-in speed V1. Thereafter, the cut-in speed is switched from second cut-in speed V2 to a rough feeding speed (third cut-in speed) V3 at the timing (time t2) of the contact detection through grinding motive power, rough feeding speed V3 being lower than second cut-in speed V2.

First cut-in speed V1 can be set to, for example, a speed about seven times as high as rough feeding speed V3. Second cut-in speed V2 can be set to, for example, a speed about three times as high as rough feeding speed V3.

Figure 5:
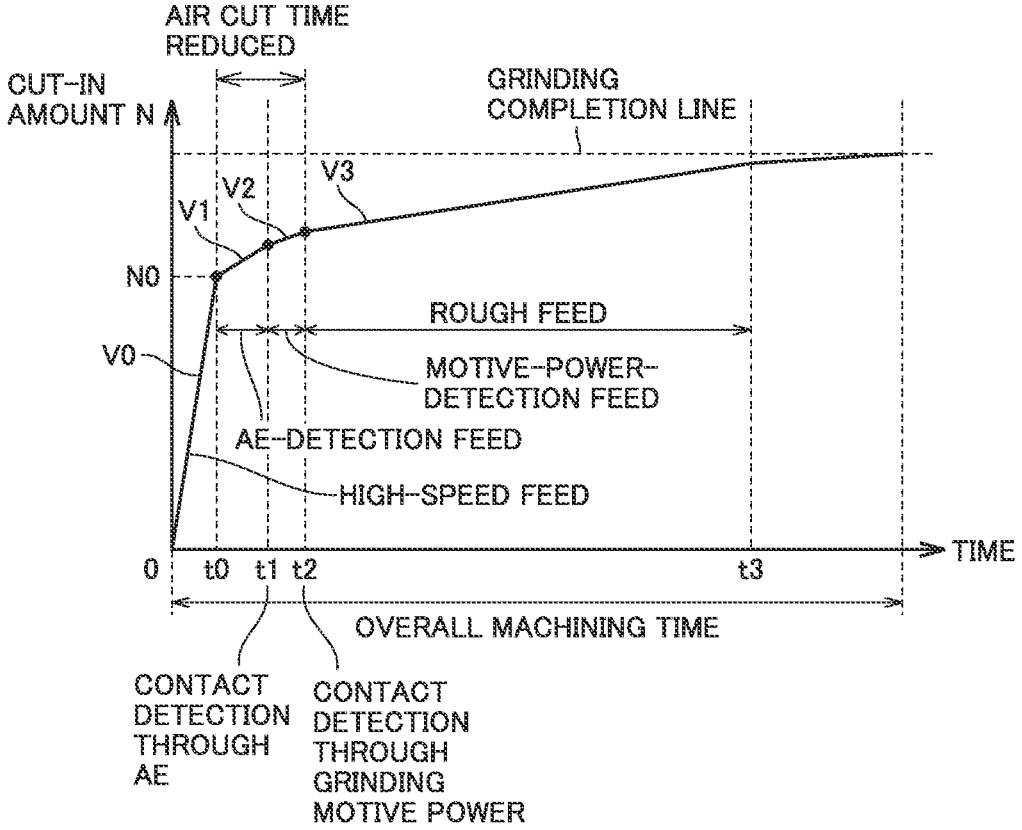
FIG. 5 is a graph showing a relation between a cut-in amount N and a machining time.

FIG. 5 is a graph showing a relation between a machining time and an amount of movement (hereinafter also referred to as "cut-in amount") N of grinding member 5 from an initial position in the X axis direction. It should be noted that FIG. 5 shows an example in which the cut-in speed is set to an initial speed V0 higher than first cut-in speed V1 because it is not considered that grinding member 5 is brought into contact with workpiece 20 until cut-in amount N reaches a predetermined value NO. At a time t0 at which cut-in amount N reaches predetermined value NO, the cut-in speed is switched from initial speed V0 to first cut-in speed V1.

When the contact detection through AE is made at subsequent time t1, the cut-in speed is switched from first cut-in speed V1 to second cut-in speed V2 lower than first cut-in speed V1. Thus, the output signal of AE sensor 10, which has high sensitivity to the fluctuation of the grinding load, is used for the first stage of switching. As a result, followability of the control of the cut-in speed to the fluctuation of the grinding load is improved, thereby facilitating the control of the cut-in speed in grinding involving large load fluctuation.

When the contact detection through grinding motive power is made at subsequent time t2, the cut-in speed is switched from second cut-in speed V2 to rough feeding speed V3 lower than second cut-in speed V2. Thus, in the present embodiment, the cut-in speed between initial speed V0 and rough feeding speed V3 is switched in two stages in the order of first cut-in speed V1 and second cut-in speed V2. Thus, troubles such as deformation of the surface of grinding member 5 or burn of workpiece 20 due to grinding can be suppressed while reducing a time required to switch from initial speed V0 to rough feeding speed V3.

That is, if the cut-in speed between initial speed V0 and rough feeding speed V3 is fixed to first cut-in speed V1 higher than second cut-in speed V2 and is switched to rough feeding speed V3 at the timing of the contact detection through grinding motive power, the overall machining time can be reduced; however, the cut-in speed of grinding member 5 is maintained at relatively high first cut-in speed V1 for a while even after grinding member 5 is brought into contact with workpiece 20 as in the conventional case, with the result that deterioration of grinding member 5 and workpiece 20 (for example, deformation of the surface of grinding member 5 or burn of workpiece 20 due to grinding) may occur. Further, as another problem, the erroneous detection due to the involvement of the grinding liquid may occur. On the other hand, in the present embodiment, since the cut-in speed of grinding member 5 is switched to second cut-in speed V2 lower than first cut-in speed V1 after grinding member 5 is brought into contact with workpiece 20, the deterioration of grinding member 5 and workpiece 20 can be less likely to occur. Further, the erroneous detection due to the involvement of the grinding liquid can be also less likely to occur.

Further, if the cut-in speed between initial speed V0 and rough feeding speed V3 is fixed to second cut-in speed V2 lower than first cut-in speed V1 and is switched to rough feeding speed V3 at the timing of the contact detection through grinding motive power, the above-described deterioration of grinding member 5 and workpiece 20 or the erroneous detection due to the involvement of the grinding liquid can be less likely to occur; however, the overall machining time becomes long. On the other hand, in the present embodiment, the cut-in speed of grinding member 5 is set to first cut-in speed V1 higher than second cut-in speed V2 until the contact detection through AE is made. Thus, the overall machining time can be appropriately reduced while suppressing the deterioration of grinding member 5 and workpiece 20.

Figure 6:
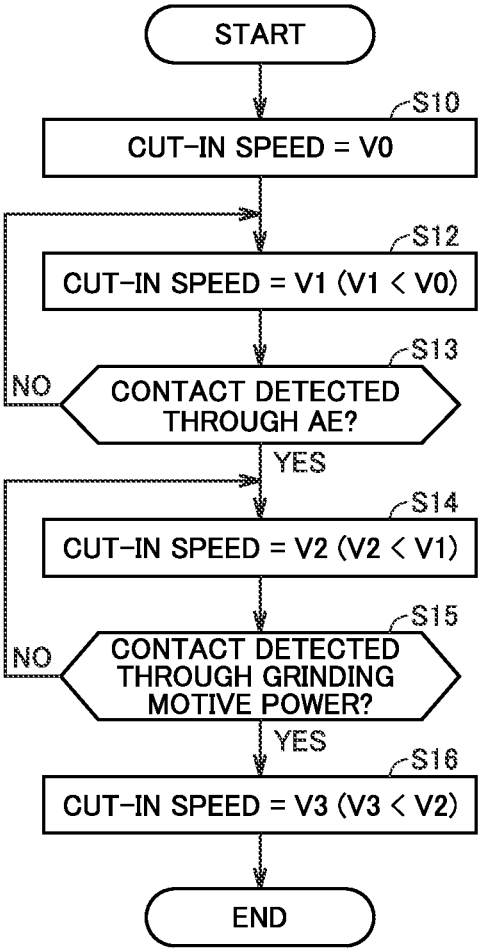
FIG. 6 is a flowchart showing an exemplary process procedure performed when the controller controls a cut-in speed of a grinding member.

FIG. 6 is a flowchart showing an exemplary process procedure performed when controller 50 controls the cut-in speed of grinding member 5.

Controller 50 sets the cut-in speed to initial speed V0 until cut-in amount N (amount of movement of grinding member 5 from the initial position in the X axis direction) reaches predetermined value NO (step S10). It should be noted that whether or not cut-in amount N has reached predetermined value NO may be determined, for example, by determining whether or not a time for which grinding member 5 is moved at initial speed V0 has reached a predetermined value. Further, when cut-in amount N can be measured using an encoder or the like, it may be determined whether or not the measured value of cut-in amount N has reached predetermined value NO.

When cut-in amount N reaches predetermined value NO, controller 50 switches the cut-in speed from initial speed V0 to first cut-in speed V1 lower than initial speed V0 (step S12). As described above, first cut-in speed V1 can be set to, for example, a speed about seven times as high as rough feeding speed V3.

Next, controller 50 determines whether or not contact is detected through AE (step S13). When contact is not detected through AE (NO in step S13), controller 50 returns the process to step S12 and maintains the cut-in speed at first cut-in speed V1.

When contact is detected through AE (YES in step S13), controller 50 switches the cut-in speed from first cut-in speed V1 to second cut-in speed V2 lower than first cut-in speed V1 (step S14). As described above, second cut-in speed V2 can be set to, for example, a speed about three times as high as rough feeding speed V3.

Next, controller 50 determines whether or not contact is detected through grinding motive power (step S15). When contact is not detected through grinding motive power (NO in step S15), controller 50 returns the process to step S14 and maintains the cut-in speed at second cut-in speed V2.

When contact is detected through grinding motive power (YES in step S15), controller 50 switches the cut-in speed from second cut-in speed V2 to rough feeding speed V3 lower than second cut-in speed V2 (step S16).

As described above, cut-in speed control unit 53 according to the present embodiment switches the cut-in speed of grinding member 5 in two stages at appropriate timings by using both the results of the contact detection through grinding motive power and the contact detection through AE. Thus, the overall machining time can be appropriately reduced while appropriately performing grinding.

(Pass Frequency Band of AE Amplifier 54)

Grinding apparatus 1 according to the present embodiment includes AE amplifier 54 (band-pass filter) that only allows for passage of a signal in a specific pass frequency band with regard to the AE wave signal detected by AE sensor 10. The pass frequency band is set to an optimal region in accordance with frequency waveforms before and after workpiece 20 and grinding member 5 are brought into contact with each other.

Figure 7:
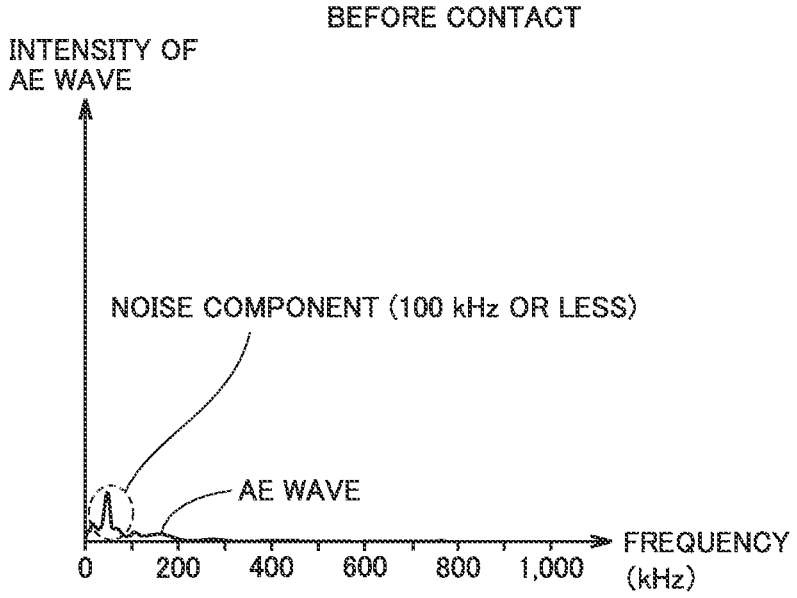
FIG. 7 is a diagram showing an exemplary frequency characteristic of an AE wave detected by an AE sensor before the grinding member and a workpiece are brought into contact with each other.

FIG. 7 is a diagram showing an exemplary frequency characteristic of the AE wave detected by AE sensor 10 before grinding member 5 and workpiece 20 are brought into contact with each other. In each of FIG. 7 and FIG. 8 described later, the horizontal axis represents the frequency (unit: kHz) of the AE wave, and the vertical axis represents the intensity (magnitude) of the AE wave. It should be noted that the frequency characteristic shown in each of FIG. 7 and FIG. 8 described later can be obtained, for example, by performing fast Fourier transform onto the AE wave signal detected by AE sensor 10.

Before grinding member 5 is brought into contact with workpiece 20, as shown in FIG. 7, a frequency band of 100 kHz or less includes noise components generated due to involvement of the grinding liquid and due to contact between the shoe (positioning supporting portion 3*a*, 3*b*) and workpiece 20.

Figure 8:
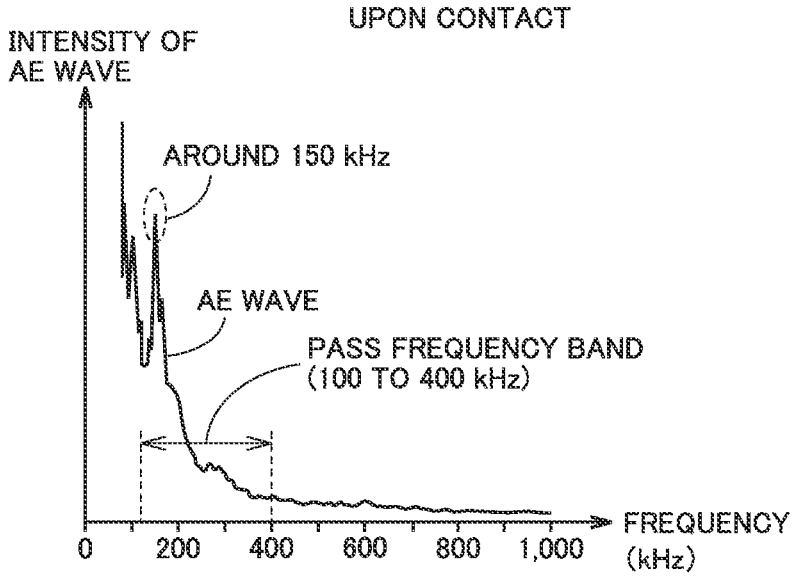
FIG. 8 is a diagram showing an exemplary frequency characteristic of an AE wave detected by the AE sensor when the grinding member and the workpiece are brought into contact with each other.

FIG. 8 is a diagram showing an exemplary frequency characteristic of the AE wave detected by AE sensor 10 when grinding member 5 and workpiece 20 are brought into contact with each other. In general, an AE frequency generated from a metal material is about 100 kHz to 300 kHz.

As shown in FIG. 8, an AE frequency when grinding a hardened steel by grinding apparatus 1 according to the present embodiment was about 150 kHz.

Therefore, in grinding apparatus 1 according to the present embodiment, in order to secure an S/N (signal/noise ratio), the pass frequency band of AE amplifier 54 is set to a band of 110 kHz to 400 kHz that falls out of the band of 100 kHz or less having a great influence of the noise components (noise caused by involvement of the grinding liquid, contact between the shoe and workpiece 20, and the like) and that includes the AE frequency of 150 kHz obtained when grinding member 5 and workpiece 20 are brought into contact with each other. By setting AE amplifier 54 (band-pass filter) having such a pass frequency band, the contact between grinding member 5 and workpiece 20 can be precisely detected through AE.

As described above, a grinding apparatus 1 according to the present embodiment includes: a grinding member driving unit 6 (rotation apparatus) having a motor that rotates a grinding member 5; a table driving unit 8 (moving apparatus) that brings grinding member 5 into contact with a workpiece 20 by moving grinding member 5 and workpiece 20 relative to each other; an AE sensor 10 that detects an acoustic emission generated when grinding member 5 and workpiece 20 are brought into contact with each other; and a controller 50 that controls a cut-in speed of grinding member 5 into workpiece 20 by controlling table driving unit 8.

Controller 50 controls the cut-in speed using an output of AE sensor 10 and a motor current of grinding member driving unit 6. Specifically, controller 50 performs a process (first process) of detecting the contact between grinding member 5 and workpiece 20 based on the output of AE sensor 10, and performs a process (second process) of detecting the contact between grinding member 5 and workpiece 20 based on the motor current. Further, controller 50 sets the cut-in speed to a first cut-in speed V1 until the contact is detected through the first process, controller 50 sets the cut-in speed to a second cut-in speed V2 until the contact is detected through the second process after the contact is detected through the first process, second cut-in speed V2 being lower than first cut-in speed V1, and controller 50 sets the cut-in speed to a rough feeding speed V3 after the contact is detected through the second process, rough feeding speed V3 being lower than second cut-in speed V2. Thus, the cut-in speed between initial speed V0 and rough feeding speed V3 is switched in two stages in the order of first cut-in speed V1 and second cut-in speed V2. Therefore, as compared with a case where the cut-in speed between initial speed V0 and rough feeding speed V3 is fixed to first cut-in speed V1 or second cut-in speed V2, deterioration of grinding member 5 and workpiece 20 can be appropriately suppressed while appropriately reducing an overall machining time.

Further, grinding apparatus 1 according to the present embodiment includes an AE amplifier 54 (band-pass filter) having a pass frequency region corresponding to a band of 110 kHz to 400 kHz that falls out of a band of 100 kHz or less having a great influence of noise components and that includes an AE frequency of 150 kHz obtained when grinding member 5 and workpiece 20 are brought into contact with each other. Controller 50 performs the first process (process of contact detection through AE) based on the AE wave having passed through AE amplifier 54. Therefore, the contact between grinding member 5 and workpiece 20 can be precisely detected through AE.

Modification

In the above-described embodiment, AE sensor 10 is fixed to the upper surface (end surface in the Z-axis positive direction) of supporting base 4, but the installation location of AE sensor 10 is not limited thereto. For example, AE sensor 10 may be disposed between positioning supporting portions 3*a*, 3*b* in supporting base 3.

It should be noted that in order to promptly and precisely detect an AE wave when grinding member 5 and workpiece 20 are brought into contact with each other, the installation location of AE sensor 10 is desired to satisfy the following conditions 1 to 4.

(Condition 1) The installation location of AE sensor 10 is close to the contact point between grinding member 5 and workpiece 20.

This is due to the following reason: the AE wave is close to a sound wave in its characteristic and is therefore attenuated more in response to an increased distance.

(Condition 2) A small number of components are present from the contact point between grinding member 5 and workpiece 20 to AE sensor 10.

This is due to the following reason: the AE wave may be diffused into air from a gap between the components and may be accordingly attenuated.

(Condition 3) A surface to which AE sensor 10 is attached is composed of steel and is smooth.

This is due to the following reason: the AE wave is prevented from being diffused into air from a gap at the surface to which AE sensor 10 is attached.

(Condition 4) The installation location of AE sensor 10 is located away from a disturbance (noise) factor.

In order to minimize an influence by disturbance, the installation location is desirably located away from a location at which a large amount of grinding coolant is scattered, a location close to a machine that is rotated at a high speed, and a location close to a component (high-frequency inverter or the like) that emits an electronic noise.

The embodiments disclosed herein are illustrative and non-restrictive in any respect. The scope of the present disclosure is defined by the terms of the claims, rather than the embodiments described above, and is intended to include any modifications within the scope and meaning equivalent to the terms of the claims.

REFERENCE SIGNS LIST

1: grinding apparatus; 2: workpiece holding unit; 3, 4: supporting base; 3*a*, 3*b*: positioning supporting portion; 5: grinding member; 6: grinding member driving unit; 7: movable table; 8: table driving unit; 9: rotation unit; 10: AE sensor; 16: current sensor; 20: workpiece; 50: controller; 53: cut-in speed control unit; 54: amplifier; 55: first contact detection unit; 56: second contact detection unit.

The invention claimed is:

1. A grinding apparatus comprising:

a rotation apparatus having a motor that rotates a grinding member;

a moving apparatus that brings the grinding member into contact with a workpiece by moving the grinding member and the workpiece relative to each other;

an AE sensor that detects an acoustic emission generated when the grinding member and the workpiece are brought into contact with each other; and a controller that controls a cut-in speed of the grinding member into the workpiece by controlling the moving apparatus, wherein the controller controls the cut-in speed using an output of the AE sensor and an output of the motor, the controller performs a first process of detecting the contact between the grinding member and the workpiece based on the output of the AE sensor, the controller performs a second process of detecting the contact between the grinding member and the workpiece based on the output of the motor, the contact being detected through the second process when the output of the motor exceeds a predetermined threshold, the controller sets the cut-in speed to a first speed until the contact is detected through the first process, the controller, in response to the contact being detected through the first process, sets the cut-in speed to a second speed lower than the first speed and maintains the cut-in speed at the second speed until the contact is detected through the second process, and the controller, in response to the contact being detected through the second process, sets the cut-in speed to a third speed lower than the second speed.

2. The grinding apparatus according to claim 1, wherein the controller includes a band-pass filter that only allows for passage of a signal in a specific frequency region with regard to the output of the AE sensor, and the controller performs the first process based on the output of the AE sensor having passed through the band-pass filter.

3. The grinding apparatus according to claim 1, wherein the grinding apparatus includes a current sensor that detects a current of the motor, and the controller performs the second process based on the current of the motor detected by the current sensor.

* * * * *